US006013022A

United States Patent [19]

Jones et al.

[11] Patent Number: 6,013,022

[45] Date of Patent: Jan. 11, 2000

[54] TILT MECHANISM FOR INFANT CARE APPARATUS

[76] Inventors: Thomas C. Jones, 5329 Lightning View Rd., Columbia, Md. 21045; Stephen J. Sweeney, 617 Lynn Way, Sykesville, Md. 21784; Christopher A. Dykes, 2276 Canteen Cir., Odenton, Md. 21113; Patrick Jordan, 6962 Knighthood La., Columbia, Md. 21045

[21] Appl. No.: 09/106,665

[22] Filed: Jun. 29, 1998

[51] Int. Cl.[7] ..... A61G 11/00

[52] U.S. Cl. ..... 600/22

[58] Field of Search ..... 600/21–22; 5/607–608, 5/610–612, 11

[56] References Cited

U.S. PATENT DOCUMENTS

| | | | |
|---|---|---|---|
| 4,885,918 | 12/1989 | Vaccaro | 600/22 |
| 5,244,452 | 9/1993 | Vaccaro et al. | 600/22 |
| 5,531,663 | 7/1996 | Gloyd et al. | 600/22 |

*Primary Examiner*—John P. Lacyk

*Attorney, Agent, or Firm*—Roger M. Rathbun

[57] ABSTRACT

An infant care apparatus that has a infant bed tilt mechanism that can be accessed by the user in close proximity to the infant mattress and at the mattress level. When the infant care apparatus is an infant incubator, the tilt mechanism is operable internal of the infant compartment. The user can thus be carrying out some procedure on the infant within that infant compartment of the incubator or at the level of the infant bed of an infant warmer and be able to alter the tilt angle of the infant bed without breaking the semi sterile conditions surrounding the infant and its close proximity by manipulation of a actuating mechanism that is situated at the level of the infant bed and in close proximity to the infant. The tilt mechanism itself has a lead screw rotatable mounted to the infant bed and which passes through a threaded nut that is resiliently affixed to the base of the incubator or infant warmer. A braking mechanism allows the user to unlock the lead screw quietly so that it is free to rotate smoothly to adjust the tilt angle of the infant bed and then relock the lead screw quietly to prevent its rotation with respect to the infant bed to lock the infant bed into that new tilt angle.

17 Claims, 9 Drawing Sheets

TILT MECHANISM FOR INFANT CARE APPARATUS

BACKGROUND

This invention relates to apparatus for the caring for an infant and, more particularly, to a means of setting and adjusting the tilt angle of an infant mattress or bed located within an infant incubator or infant warmer through the use of a mechanism that is adjusted by the user internal of the infant compartment or in close proximity to the infant bed at the level of the infant bed where the infant is positioned.

Infant incubators have a wide variety of ways to vary and set the tilt angle of the infant lying upon a mattress within the apparatus. One such mechanism is shown and described in U.S. Pat. No. 5,531,663 and which is owned by the present assignee and which describes an infant mattress having a tilt mechanism that is accessed by some mechanism located outside the infant incubator itself.

As described in that patent, the use of various tilting mechanisms are valuable in positioning the infant at a range of desired tilt angles and most incubators currently available have some means of adjusting that angle. It is, of course, advantageous that the tilt mechanism be relatively simple to operate, be relatively inexpensive and uncomplicated and be capable of placing the infant in a wide latitude of positions within the incubator infant compartment. Additionally, it is important that the tilt mechanism allow the infant mattress to tilt smoothly and quietly and be damped so that it stops at the desired tilt angle readily and be lockable into that position.

Likewise, infant warmers also have mechanisms to enable the operator to tilt the infant bed to a desired position and one such tilt mechanism is shown and described in U.S. Pat. No. 4,628,553 where a hydraulic system allows the bed to be placed at the desired tilt angle and then maintained in that position by simply releasing the mechanism to halt the flow of hydraulic fluid within the system.

In either case, it is of considerable value that the tilt mechanism be able to quickly reach the desired tilt angle and to be firmly retained at that angle with some positive locking arrangement so that the infant mattress is not inadvertently moved during some procedure being carried out on the infant by attending personnel.

One difficulty with present tilt mechanism for infant incubators is, however, that the mechanisms are operated from outside the infant compartment and mattress where the infant is positioned. Although there are desirable features of a system operated external of the infant compartment, there are also advantages to be able to change the tilt angle of the infant by some mechanism that is actually located within the infant compartment in close proximity to the mattress. As an example, with an external mechanism, the attending personnel may be operating on the infant and desire to change the tilt angle and in most cases are wearing protective gloves. Thus, if there is a desire to change the tilt angle, the user is required to remove a gloved hand from the semi sterile environment of the infant compartment to reach the external tilt mechanism, thus affecting the semi sterile condition of that gloved hand for further attending to the infant. Thus, the potential exists for cross contaminating the infant with other outside sources of infection from outside the mattress area and below the bed level.

Accordingly, to return to continue the procedure on the infant requires the personnel to again clean the hand, or gloved hand to continue the work, thus disrupting the procedure on the infant and creating a cumbersome hand cleaning procedure.

Additionally, in the case of an infant warmer, the close proximity of the tilt activation means to the infant allows the user to continue attending to the infant without regloving.

SUMMARY OF THE INVENTION

There is herein described an infant care apparatus bed tilt mechanism that is fully usable from within the interior of the infant compartment, that is, the compartment containing the infant in the protective environment or in close proximity to the infant bed and at the level of the infant bed of an infant warmer. The present mechanism allows the attending personnel to affect the tilt angle without disrupting the semi sterile condition of the infant compartment or infant bed and to make the change in tilt angle quickly, easily and with little disruption to the infant. As a result, the nurse can change the tilt angle while his or her hands are already within the infant compartment or in close proximity to the infant bed carrying out some procedure on the infant and have a good feel for the change in position.

That present tilt mechanism provides a smooth, damped movement of the infant mattress to any tilt angle desired within a range of movement and the control of the tilt angle can be carried out immediately when the infant is being attended to rather that interrupt the procedure to reach for an external tilt angle mechanism.

Accordingly, in carrying out the present invention, the infant bed supporting the infant mattress on which the infant is positioned is pivoted for movement so that it can be tilted to various positions. A rotatable screw is rotatably affixed to the infant bed and which extends downwardly through a threaded nut flexibly affixed to a fixed part of the incubator base. A locking mechanism is provided to prevent the screw from turning when the user desires the infant bed to be fixed in the desired position.

Therefore by the interfit between the rotatable screw and the nut, the infant bed can be unlocked, moved to the desired tilt angle and then re-locked in that position. The interaction of the screw and the nut is such that there is a damping effect yet the infant bed can be readily moved or tilted to the position easily by the attending personnel. The locking mechanism that is operated by the user to change the tilt angle is contained fully within the infant compartment and therefore the personnel can readily change the angle without withdrawing his or her hand from the infant compartment or from the level of the infant bed. As such, therefore, the semi sterile environment is not contaminated by the touching of some mechanism outside of the infant compartment or by reaching away from the level of the infant bed.

DETAILED DESCRIPTION OF THE INVENTION

Figure 1A:
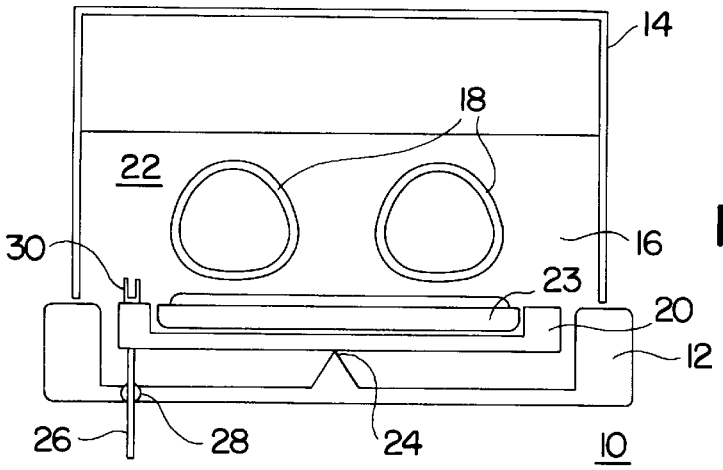
FIGS. 1A, 1B and 1C are schematic views of an incubator constructed in accordance with the present invention having an internal tilt mechanism.
Figure 1B:
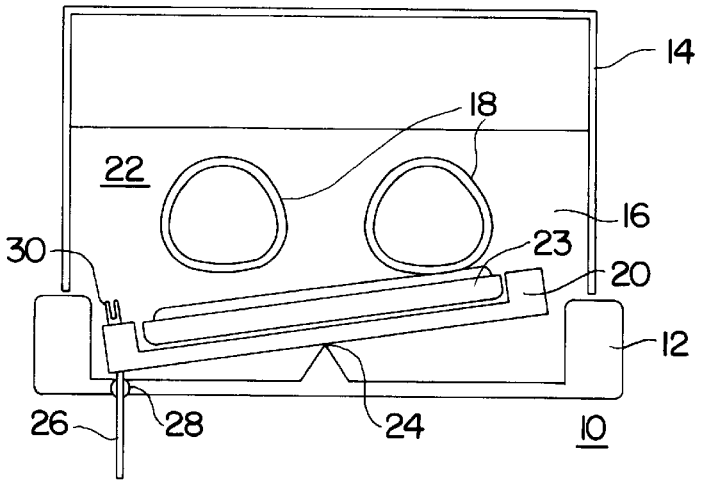
Figure 1C:
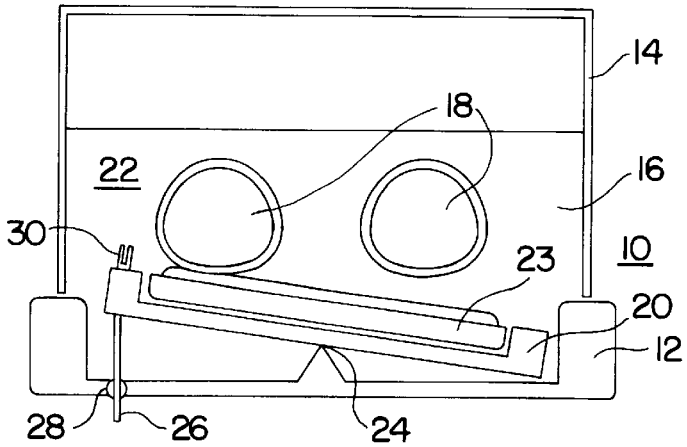

Referring now to FIGS. 1A–1C, there is shown a schematic view of an infant incubator 10 having incorporated therein, the tilt mechanism of the present invention and showing various tilt angles. A typical incubator that may employ the present tilt mechanism is shown and described in U.S. Pat. No. 4,936,824 of Koch et al and the description in that patent is incorporated herein by reference. As noted, the present infant bed tilt mechanism can by used on various infant care apparatus, and the description herein set forth will focus on the user of the tilt mechanism in connection with an infant warmer and an infant incubator.

Basically, the incubator shown in FIGS. 1A–1C includes a base 12 and which is shown schematically, however the base 12 may also enclose the various equipment for operating the incubator 10 including a heater and various ducting to provide heated air to provide the desired environment for the infant.

A hood 14 sits atop the base 12 of incubator 10 and is generally comprised of a transparent material so that attending personnel can easily view the infant contained within the incubator 10. In general and as more fully explained in the aforementioned U.S. Patent, the hood 14 may include a front door 16 and one or more handholes 18 for access to the infant.

Therefore, an infant compartment 22 is formed beneath the hood 14 and above the base 12. An infant bed 20, including an infant mattress 23 for the comfort of the infant, is positioned within that infant compartment 22 and therefore within the environment that is carefully controlled so as to protect the infant positioned on the infant bed 20. Accordingly, as will become apparent, the infant compartment 22 provides the controlled environment for the infant and is intended to be semi-sterile, that is, the conditions are such that only certain clean materials and certain items are allowed into the infant compartment 22 and that contamination from other patients or external sources is not allowed into the infant compartment 22.

As also can be seen in the FIGS. 1A–1C, the schematic views show the infant bed 20 to be affixed to a pivot point 24 such that the infant bed 20 can be tilted in either direction about that pivot point 24 and which, in turn, is fixed with respect to the base 12. Accordingly, the infant bed 20 can be tilted to any variety of tilt angles about the pivot point 24 to allow the user to set the tilt angle of the infant to a desired position.

A lead screw 26 is shown connected to the infant bed 12 and extends downwardly and passes through a threaded nut 28 affixed to the base 12. The lead screw 26 is preferably a fast pitch lead screw and the threaded nut 28 is also of a particular preferred type, to be explained, and the combination of the fast pitch lead screw 26 passing through the threaded nut 28 allows the infant bed 12 to be tilted readily to the desired position with little effort and with good stability. One supplier of the lead screws for this invention and the threaded nuts is Ball Screw & Actuators Co. Inc. of San Jose, Calif. The lead screw 26 is connected to the infant bed 12 in a preferred manner but is it is important to note that the lead screw 26 is rotatably affixed to the infant bed 20 so that it can normally freely rotate as it passes through the threaded nut 28 as the tilt angle is changed by the user. Also of importance is the affixation of the threaded nut 28 to the base 12 since there must be a certain flexibility of the threaded nut 28 and the base 12 so that the tilting of infant bed 20 is continuous and a relatively smooth, constant force is require to carry out the tilting.

An internal actuating mechanism 30 is positioned within the infant compartment 22 and, as will be seen, the internal actuating mechanism 30 allows the user to activate the tilt mechanism to reposition the infant bed 20 to the desired tilt angle and to utilize the actuating mechanism 30 to again fix the infant bed 20 in that selected position.

As previously explained, it is a significant advantage that the actuating mechanism 30 be internal of the infant compartment 22 so that the user can carry out the use of the tilt mechanism without removing his or her hand from the infant compartment 22 and thus not cross contaminate the semi sterile condition within that infant compartment 22. Thus, in the present invention, the internal actuating mechanism 30 is, as is shown, fully within the infant compartment 22 and can be accessed by the user to release the infant bed 20 from a locked position, allow the user to readjust the infant bed angle as desired and then re-lock the infant bed 20 in the new tilt angle position.

Figure 2:
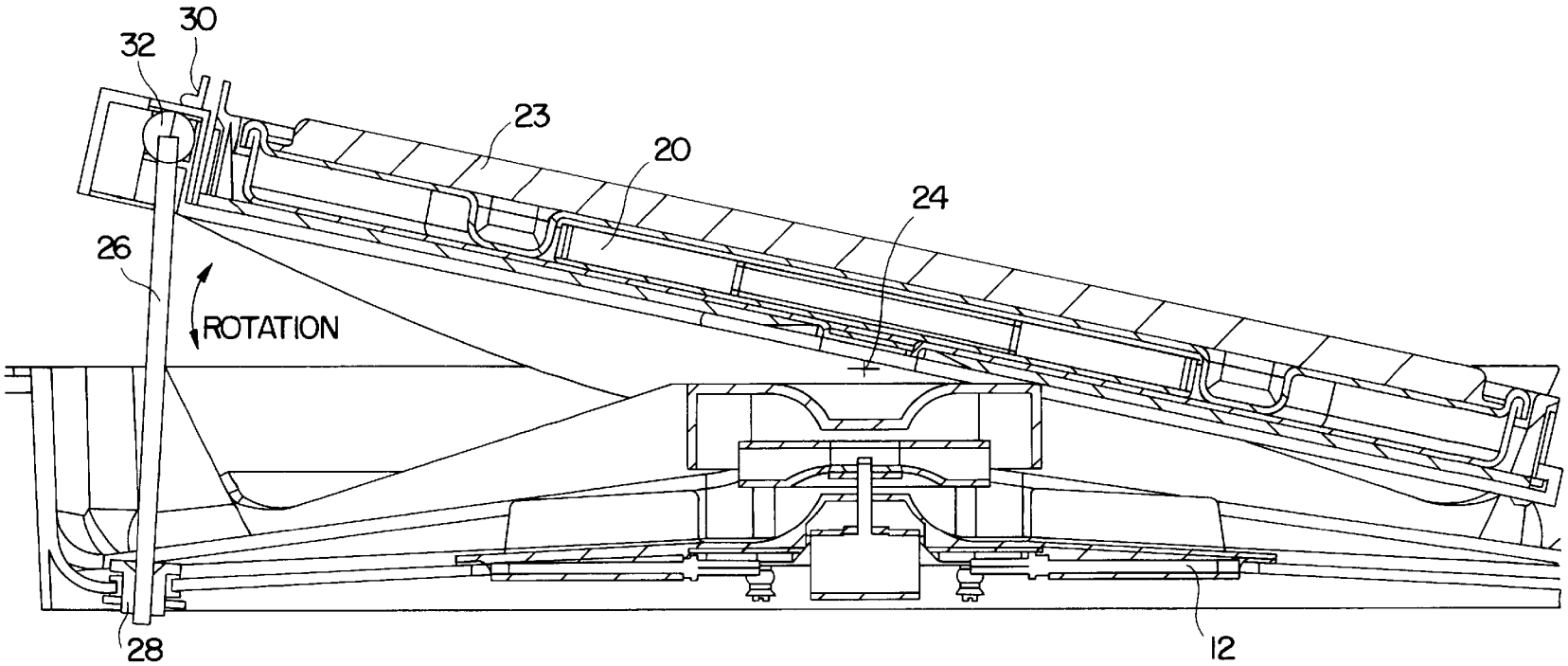
FIG. 2 is a side cross sectional view of the tilt mechanism of the present invention.

Turning now to FIG. 2, there is shown a cross-sectional view showing the details of the tilt mechanism constructed in accordance with the present invention. As shown, therefore, the base 12 is supporting the infant bed 22 by underlying the mattress 23 upon which the infant is positioned. As noted, the infant bed 20 can tilt about a pivot point 24 from side to side as desired by the user. The lead screw 26 is rotatably affixed to the infant bed 20 and passes through the threaded nut 28 where it is freely rotatable when the user is adjusting the tilt angle of the infant bed 20. At the end of the lead screw 26, there is a ball 32 affixed thereto and which is, as indicated, freely rotatable when the infant bed is being tilted, but, as will be explained, the ball 32 can be locked in a non-rotating position upon use of the actuating mechanism 30. Accordingly, while the lead screw 26 rotates freely when the infant bed 20 is being adjusted by the user to a particular tilt angle, the ball 32 is free to rotate and thus, so is the lead screw 26 so that the tilt adjustment can be made. When the desired tilt angle has, however, been reached, a locking mechanism, operated by the internal actuating mechanism 30 clamps against the ball 32 and prevents its further rotation. Since the ball 32 and the lead screw 26 can no longer rotate, the infant bed 20 is fixed in its position at that particular tilt angle. Therefore, by simply utilizing the internal actuating mechanism 30 that is located internal of the infant compartment 22 (FIGS. 1A–1C), the user can unlock the infant bed 20, change its tilt angle and again lock the infant bed 20 into the new position.

The use of ball 32 as the preferred embodiment is for a number of reasons, First, it is a geometric shape that can be held within a socket and be able to be movable to a variety of positions, that is, the ball 32 can be held captive yet have considerable flexibility in allowing the angle of the lead screw 26 relative to the infant bed 20 to change as the infant bed 20 moves through the various tilt positions. Second, the addition of a ball 32 increases the diameter of the lead screw 26 so that a mechanical advantage is gained in locking the lead screw 26 in its non-rotatable position to the infant bed 20. The lead screw 26 itself can be of a relatively small diameter and yet the portion of the lead screw that is acted upon by the locking mechanism is of an enlarged diameter so that the locking function is enhanced.

Figure 3:
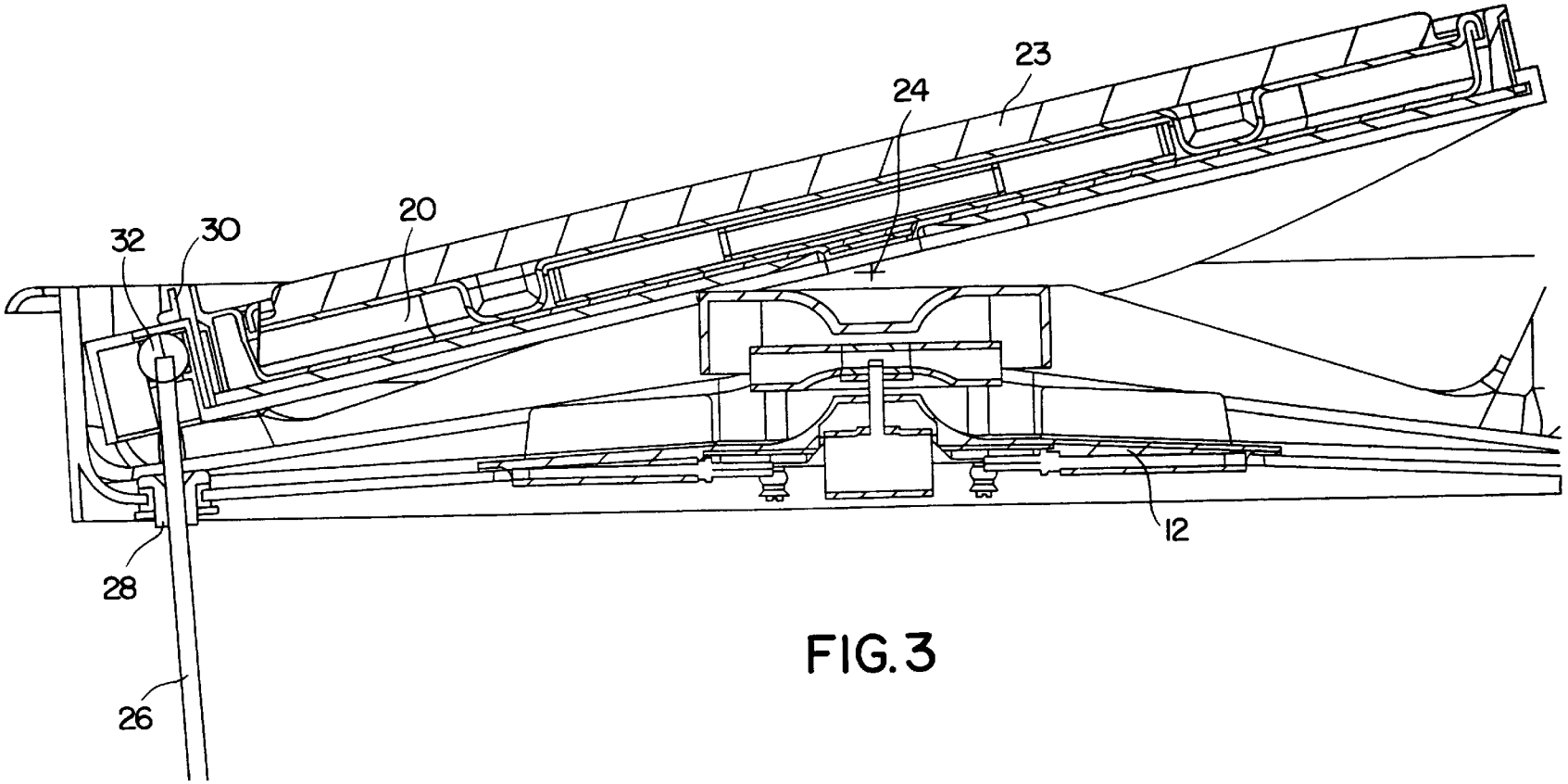
FIG. 3 is a side cross sectional view as in FIG. 2 with the infant bed is a different position.

Turning briefly to FIG. 3, there is shown a cross-sectional view of the tilt mechanism constructed in accordance with the present invention and showing the lead screw 26 fully extended through the threaded nut 28 and thus with the left side of the infant bed 20 at its lowest tilt position. At this tilt angle, it is notable that the lead screw 26 is at a significantly different attack angle as it passes through the threaded nut 28 than in the position of FIG. 2 and is the reason that the threaded nut 28 needs to be flexibly mounted to the base 12 and preferably gimbaled to the base 12 so that it can freely move a certain extent as the angle of the lead screw 28 changes in the tilting of the infant bed 20. In addition, as is also apparent, some flexibility is required in the connection between the ball 32 and the infant bed 20 such that the change in angle is possible and can be allowed without resistance. As also can be seen in both FIGS. 2 and 3, there is a internal actuating mechanism 30 that is operable by the user to release and hold the rotation of the ball 32 so as to control the rotation of the lead screw 26 and, of course, the ability to tilt the infant bed 20.

Figure 4:
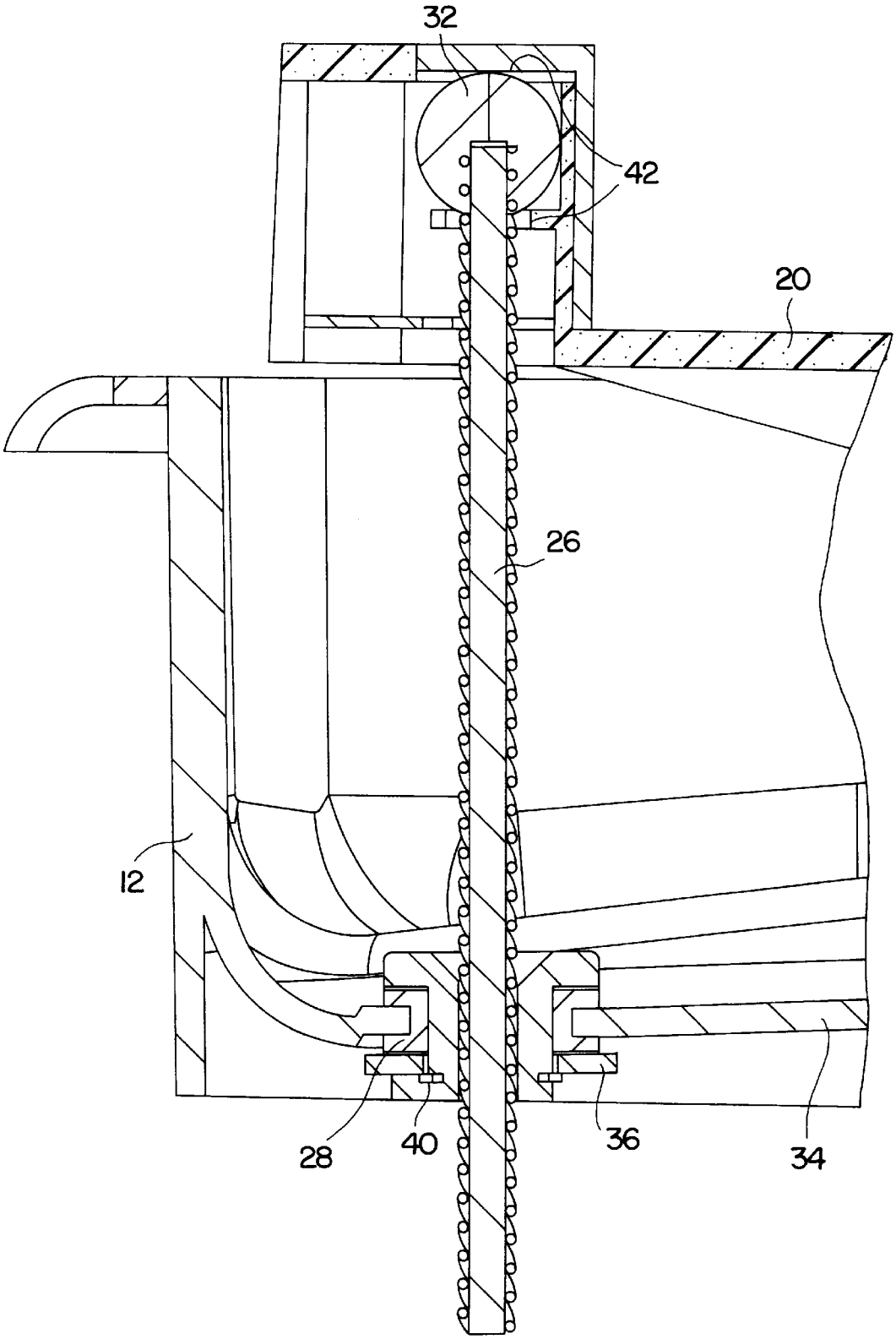
FIG. 4 is an enlarged, side cross sectional view of the tilt mechanism of the present invention.

Turning now to FIG. 4, there is shown an enlarged cross-sectional view of the tilt mechanism used in the present invention. As shown, the affixation of the threaded nut 28 can be more clearly described. As stated, the threaded nut 28 is affixed to the base 12 with sufficient flexibility as to be able to move as the angle of the lead screw 26 changes with the particular position of the infant bed 20. In the preferred embodiment, the threaded nut 28 is affixed to the base frame 34 with an intermediate flexible grommet 36 that can be held in place by means of a flat washer 38 and a C-clip 40. Obviously, other means can be used to provide the flexible connection between threaded nut 28 and the base 12 and one such means can be a gimbaled connection, it being sufficient that the threaded nut 28 be held to the base 12 but be able to flex sufficiently so as to take into account the change in attack angle of the lead screw 26 as it passes through the threaded nut 28. If there is no flexibility, the change in angle will cause the lead screw 26 to bind in the threaded nut and make movement of the infant bed 20 difficult. According, it is preferred, in carrying out the present invention, that the force exerted by the user to change the tilt angle of the infant bed 20 be constant and yet require sufficient force that the movement is damped and remain stable at whatever position the user places the infant bed 20.

Accordingly, the feel of the movement of the infant bed 20 is important in the invention and that feel can be basically affected by the selection of the pitch and thread of the lead screw 26 and the threaded nut 28. In the preferred embodiment, the lead screw 26 may be a Supernut as marketed commercially by the aforementioned Ball Screws & Actuators Co. Inc. of San Jose, Calif. and the lead screw may be a standard rolled thread fast-lead screw, also commercially available from the same company, and in particular, a $5/16^{th}$ screw with a 0.500 lead which is described as a fast lead screw and nut.

The connection between the lead screw 26 and the infant bed 20 is also of importance ands also requires a certain flexibility built into such connection. In carrying out that connection, the ball 32 is preferable supported within a socket 42. The ball 32 itself may be affixed to the lead screw 26 by various known means, and may include a pinned connection, a press fit or by some adhesive. It is important only that the ball 32 be securely affixed to the lead screw 26 and rotate therewith since the control of the rotation of the lead screw 26 is accomplished through the ball 32 as will become apparent.

Figure 5:
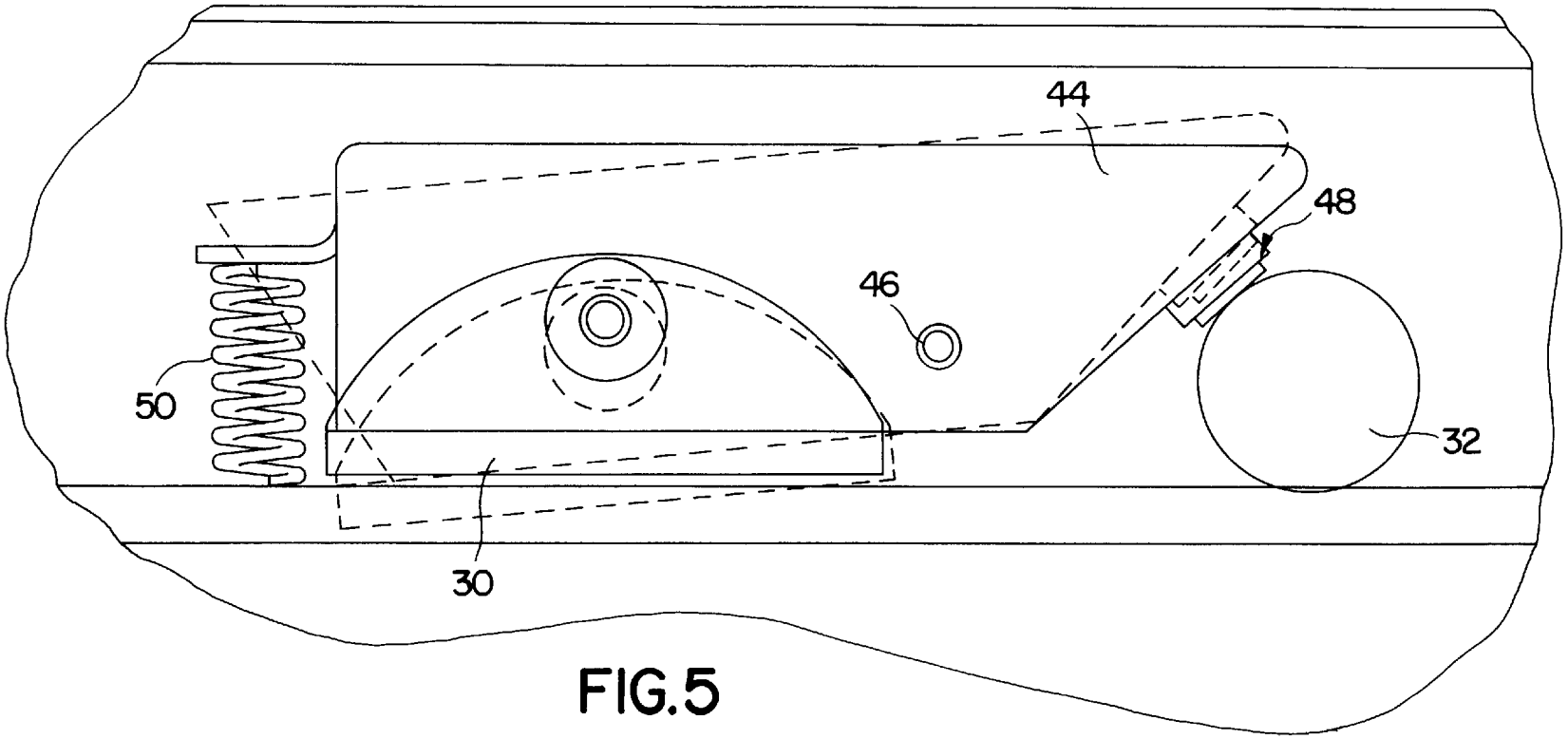
FIG. 5 is a side, broken away view of the locking mechanism used with the present invention and the actuating mechanism.

Turning now to FIG. 5, there is shown a top view, partly in section, of the tilt mechanism of the present invention and showing, in particular, the actuating mechanism 30 that is used to control the rotatability of the lead screw 26 by means of the ball 32. As is shown in this Fig., a brake release lever 44 is rotatable about a rotation point 46 such that it can move between the solid line position of FIG. 5 and the dotted line position. In the solid line position, a brake pad 48 of a durable, resilient material is seen to be directly contacting the ball 32 and therefore holds the ball 32 against rotation with respect to the socket 42 and, therefore the infant bed 20. A spring 50 biases the brake release lever 44 to the solid line position, that is, the spring 50 biases the brake release lever 44 to the braking position where the ball 32 is constrained against rotation. Accordingly, in normal operation, the ball 32 and thus the threaded screw 26 is prevented from rotation. When it is desired to change the tilt angle of the infant bed 20, (FIG. 4) the user can merely move the upwardly projecting actuating mechanism 30 located within the infant compartment 22 to depress the spring 50 and thus move the brake pad 48 away from the ball 32 to release the lead screw 26 to allow it to freely rotate. At that point, the infant bed 20 can be moved by the user to a new tilt angle. By the user releasing the projecting actuating mechanism 30, the action of spring 50 will return the brake release lever 44 to the solid line position to again lock the infant bed 20 to its new position.

Accordingly, as can now be seen, the tilt mechanism of the present invention is a relatively simple mechanism but which can be operated by the user from internal of the infant compartment 22 and without moving the hands of the user to any external mechanism to carry out the tilting of the infant bed 20. The tilt mechanism is smooth operating and has a damped effect that can be controlled by the selection of the lead screw and the threaded nut and yet the amount of force required to be exerted by the user to actually carry out a change of tilt angle is relatively slight. The tilt movement itself is characteristically smooth and is easy for the user to acquire a feel for the movement of the infant bed from one tilt angle to another.

Figure 6A:
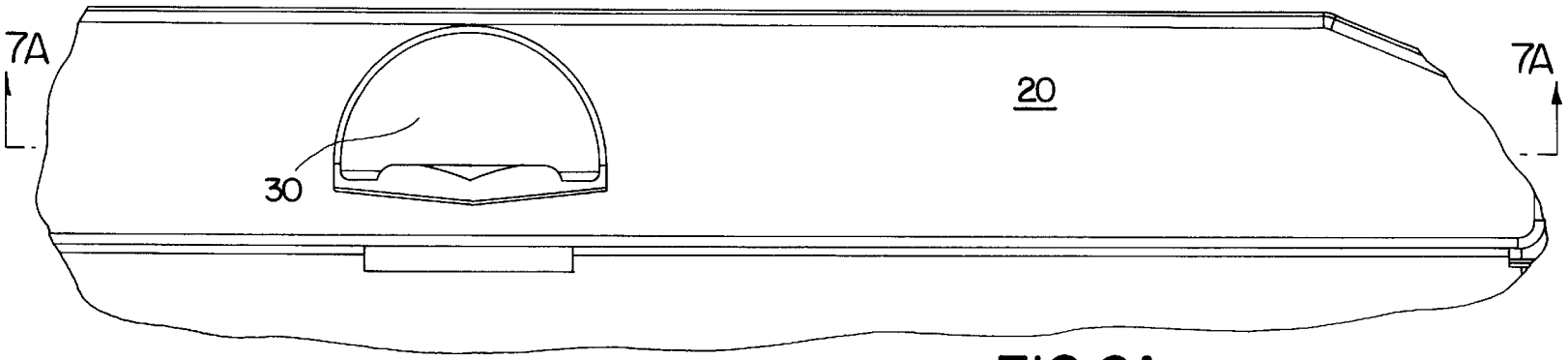
FIGS. 6A and 6B are a top view and a side view, respectively, of the tilt mechanism to illustrate its disassembly.
Figure 6B:
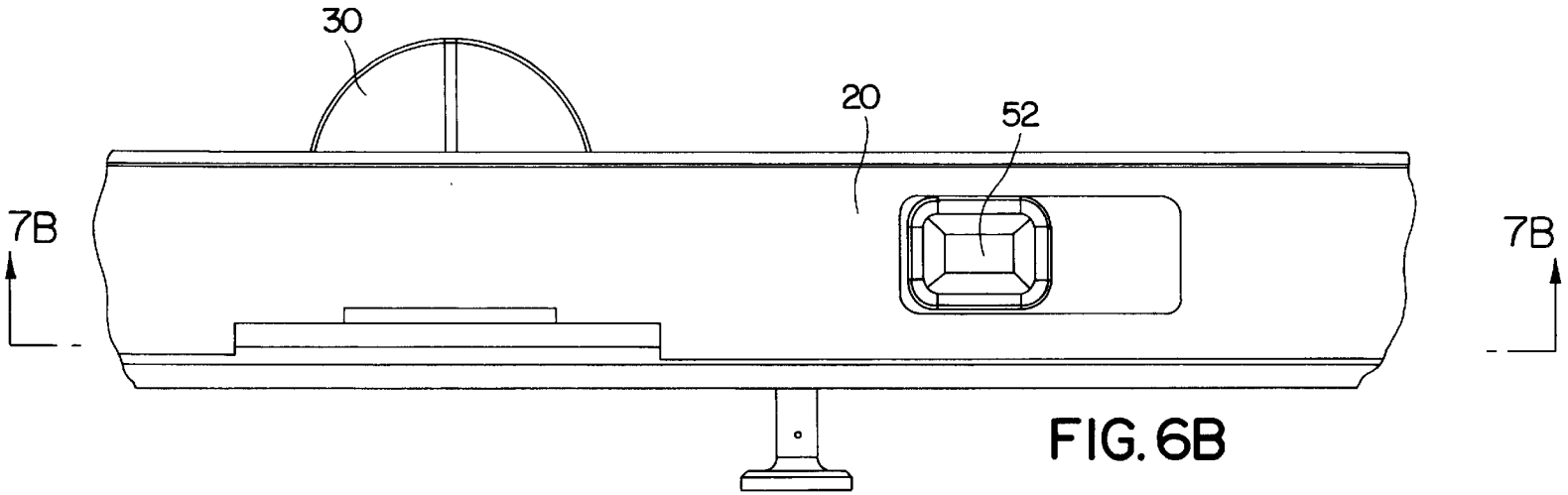
Figure 7A:
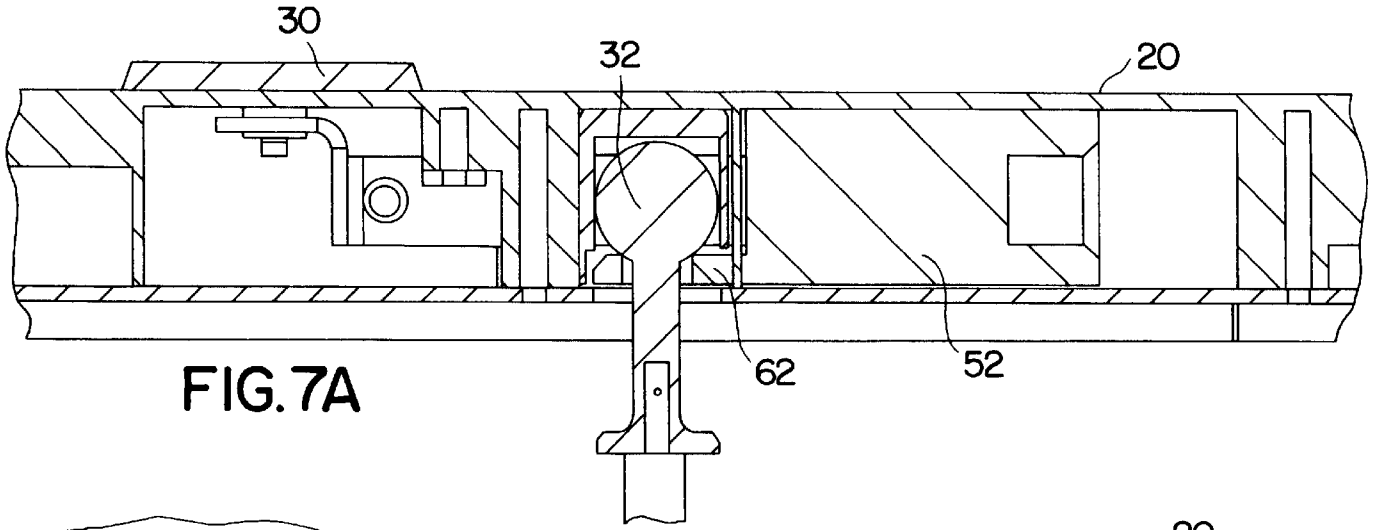
FIGS. 7A and 7B are cross sectional views taken along the lines of A—A and B—B, respectively of FIGS. 6A and 6B.
Figure 7B:
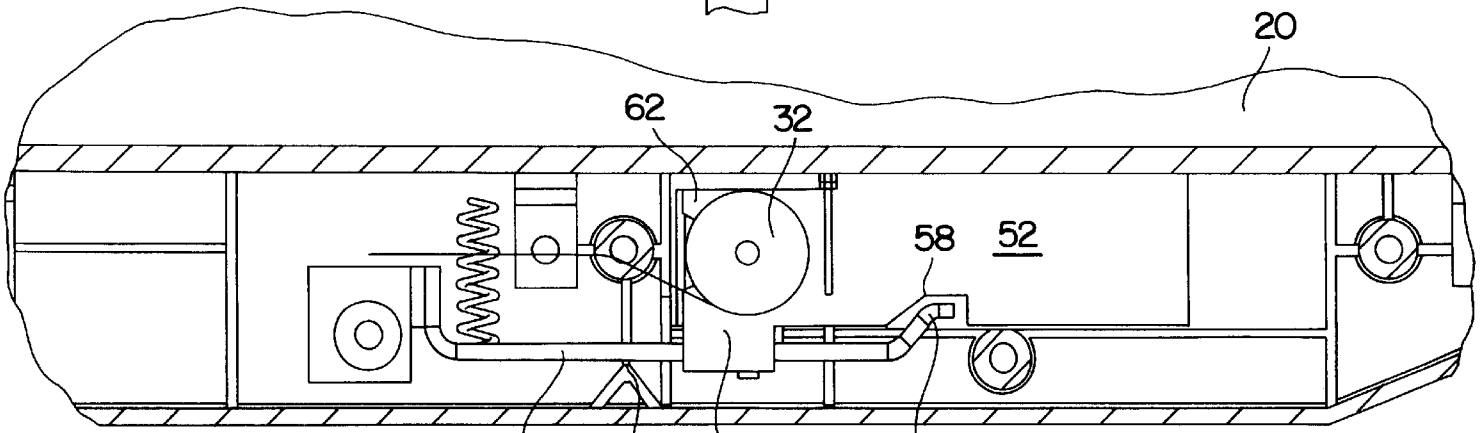
Figure 8A:
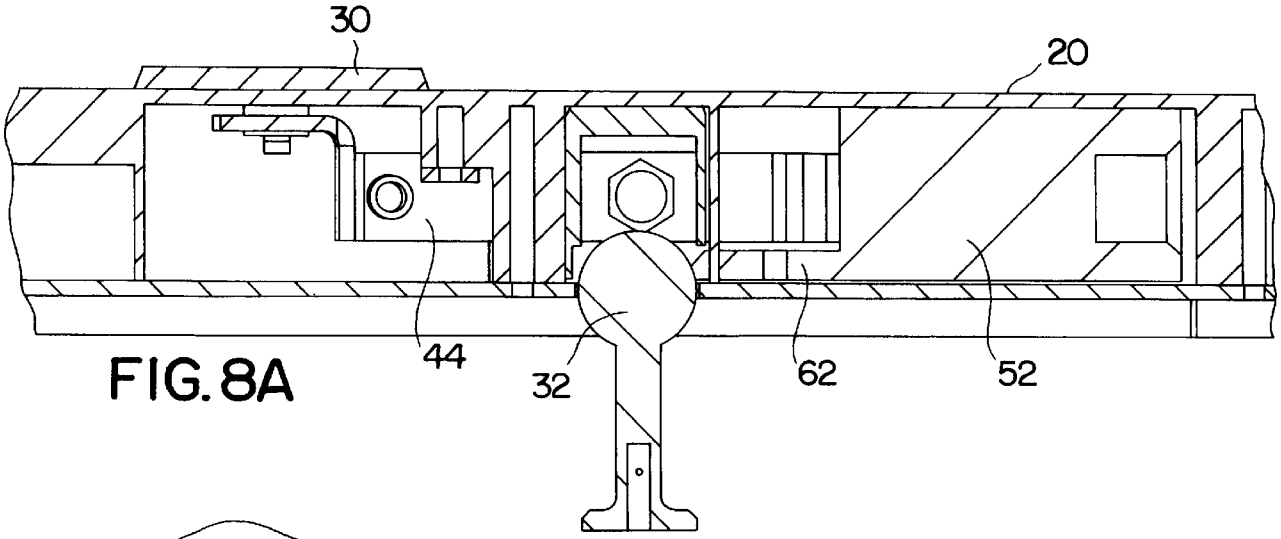
FIGS. 8A and 8B are cross sectional views taken along the lines A—A and B—B of FIGS. 6A and 6B with a mechanism in a released position.
Figure 8B:
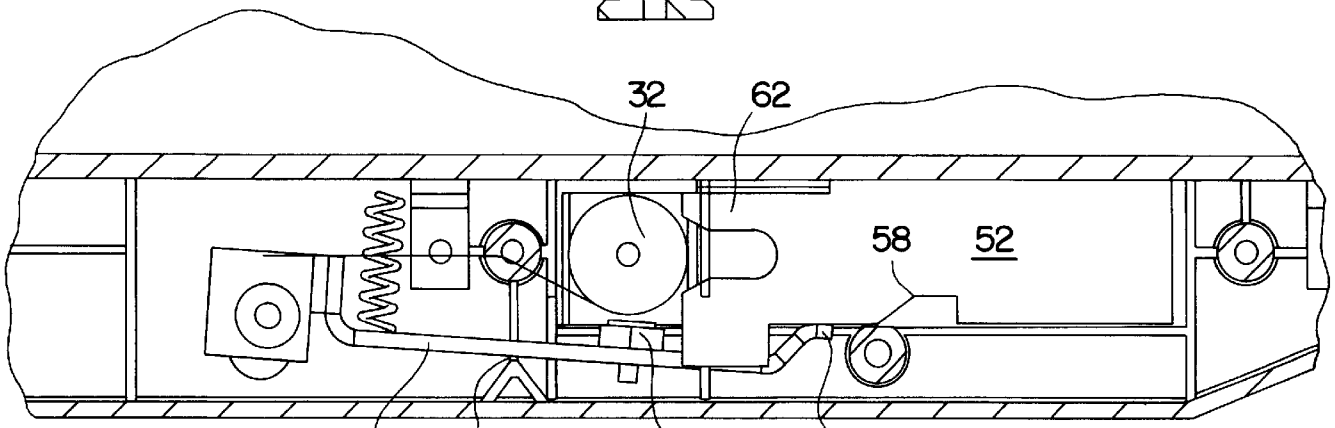

Turning now to FIGS. 6A and 6B, taken along with FIGS. 7A, 7B and 8A and 8B, there is shown a top view in FIG. 6A of the release mechanism used with the present invention to release the infant bed 20 for purposes of cleaning. FIG. 6B is a side view of the same mechanism, FIG. 7A is a cross sectional view of the mechanism of FIG. 6A taken along the lines A—A while FIG. 7B is a cross-sectional view of the mechanism of FIG. 6B taken along the lines B—B of that figure. FIGS. 8A and 8B are cross-sectional views of the same mechanism of FIGS. 7A and 7B taken along the same lines but showing the release mechanism in the released position.

In FIG. 6A, a top view is shown and where the internal actuating mechanism 30 is positioned so as to extend upwardly in order to be conveniently available to the user to release the lock on the ball 32 (not shown) so that the infant bed 20 can be moved to the desired tilt angle. The upwardly projecting actuating mechanism 30 is also shown in FIG. 6B and which also shows a ball release slide 52 that can be moved by the user to release the ball 32 (not shown) from the other components of the tilt mechanism. In FIG. 7A, there is shown the ball release slide 52 in a side cross-section and showing the ball release slide 52 in its closed position wherein the ball 32 is captured by the ball release slide 52. In this embodiment, the spring 54 provides the bias and the brake release lever 44 pivots about pivot point 54.*n* The spring 56 is compressed by the user by moving the internal actuating mechanism 30 to move the brake pad 48 away from ball 32 to release the ball 32 and, of course, the lead screw 26 for rotational movement with respect to the infant bed 20.

Ball release slide 52 has a ramped depression 58 formed therein and into which is located one end 60 of the brake release lever 44 which is also bent generally along the shape of the ramped depression 58. Accordingly, as can be seen, as the ball release slide 52 is moved away from the ball 32, the ramped depression 58 acts upon the end 60 of the brake release lever 44 causing it to move outwardly with respect to the ball 32 and to therefore release the brake pad 48 from the ball 32 by moving it away. The ball 32 is thus no longer constrained by the brake pad 48. The brake release slide 52 also has a bifurcated end 62 that, in the unreleased position as best shown in FIG. 8A, slides underneath the ball 32 to retain the ball 32 securely in the socket 42. As the ball release slide 52 is moved to the released position of FIGS. 8A and 8B, the bifurcated end 62 thus releases the ball 32 from its locked position within the socket 42. Accordingly, to release the ball 32 from the socket 42, and thus to free the infant bed 20 from the tilt mechanism, the ball release slide 52 is simply moved by the user away from the ball 32 and the bifurcated end 62 becomes freed from its holding position underneath the ball 32. At the same time, the ball release slide 52 pulls the brake pad 48 away from its position biased against the ball 32 to allow the ball 32 to be readily removed from socket 42 to disassemble the tilt mechanism for cleaning, inspection or the like.

Accordingly, by the simple movement of the ball release slide 52, the ball 32 can be released from the socket 42 and by reversing the procedure, the ball 32 can as easily, be reinserted and held captive by the socket 42 and the bifurcated end 62 of the ball release slide 52.

Figure 9:
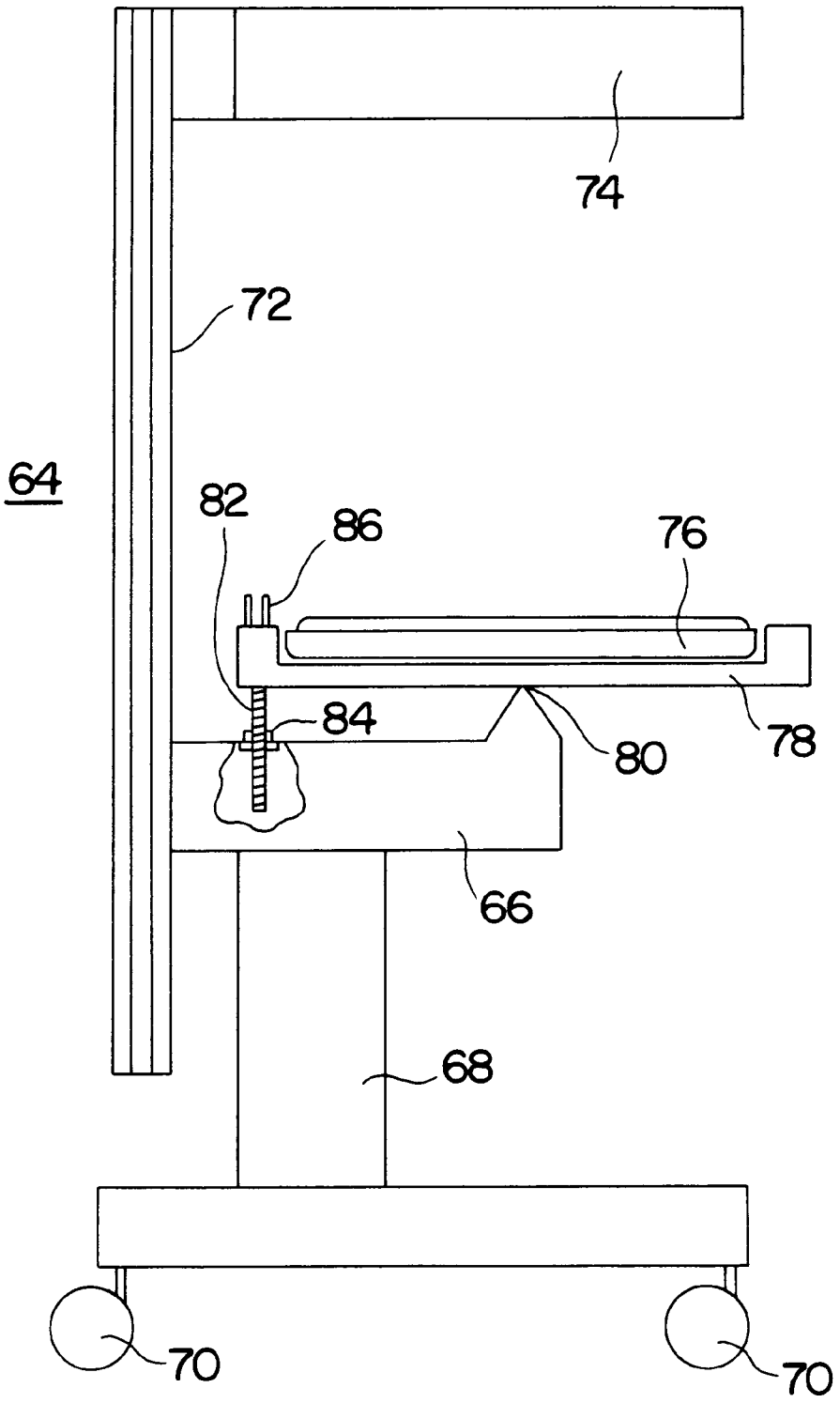
FIG. 9 is a schematic view of an infant warmer constructed in accordance with the present invention.

Turning, finally, to FIG. 9, there is shown a schematic view of an infant warmer 64 constructed in accordance with the present invention and using the basic same components as used with respect to the infant incubator of the previous Figs.

In FIG. 9, therefore, the infant warmer 64, as stated, may be similar to that of U.S. Pat. No. 4,628,553 and comprises a base 66 that may include a pedestal 68 having wheels 70 so that the infant warmer 64 is readily movable. A vertical strut 72, generally two are used, supports the heater unit 74 and which may be a quartz heater that provides the heat directed downwardly towards an infant resting upon a mattress 76 and supported by infant bed 78. Again, as noted, the infant bed 78 is pivotally mounted to the base 66 so that it can tilt with respect to that base 66 about pivot point 80. Lead screw 82 thus projects downwardly from the infant bed 78 and it is rotatably affixed to that infant bed 78. A threaded nut 84 is affixed to the base 66 in a manner as previously described so that it can move with respect to the infant bed 78 as the infant bed 78 moves through its various tilt angles. The threaded nut 84 can be affixed in some gimbaled manner as described. Again, an actuating mechanism 86 is provided that allows the user to lock the infant bed 78 in any particular desired tilt angle by preventing the rotation of the lead screw 82. As can be seen, the location of the actuating mechanism 86 is at the level of the infant bed 78 and is in close proximity thereto so that the user can readily lock and unlock the infant bed 78 with respect to the base 66 to select and hold the desired tilt angle without moving the hands away from the close proximity to the infant bed 78 and, of course, the infant. Accordingly, the user does not risk contaminating his or her hands in changing the tilt angle of the infant bed 78 so that the possibility of cross contamination is minimized.

While the present invention has been set forth in terms of a specific embodiment, it will be understood that the present internal tilt mechanism for affecting the tilt angle of an infant bed within an infant compartment of an infant incubator or used in an infant warmer as herein disclosed, may be modified or altered by those skilled in the art to other configurations. Accordingly, the invention is to be broadly construed and limited only by the scope and spirit of the claims appended hereto.

We claim:

1. An infant incubator for containing an infant, said infant incubator having a base, an infant bed for supporting an infant mounted to said base, and a incubator hood positioned atop of said base and adapted to form an infant compartment having a controlled environment with said base to contain an infant in that environment, a tilt mechanism for allowing a user to place said infant bed at a desired tilt angle with respect to said base, and an actuating mechanism adapted to be manipulated by the user to tilt said infant bed to the desired tilt angle, said actuating mechanism being located within the infant compartment.

2. An infant incubator for containing an infant as defined in claim 1 wherein said tilt mechanism comprises a lead screw rotatably affixed to said infant bed and a threaded nut affixed to said base, said threaded lead screw passing through said threaded nut, and wherein said actuating mechanism is operable by the user to control the rotatability of said lead screw.

3. An infant incubator for containing an infant as defined in claim 2 wherein said lead screw rotatably affixed to said infant bed has an increased diameter end affixed to said infant bed.

4. An infant incubator for containing an infant as defined in claim 3 wherein said increased diameter end is a spherical ball.

5. An infant incubator for containing an infant, said infant incubator having a base, an infant bed for supporting an infant mounted to said base, and a incubator hood positioned atop of said base and adapted to form an infant compartment having a controlled environment with said base to contain an infant in that environment, a tilt mechanism for allowing a user to place said infant bed at a desired tilt angle with respect to said base, said tilt mechanism comprising a lead screw rotatably affixed to said infant bed and threaded through a nut affixed to said base and a breaking mechanism operable by a user to lock and unlock said lead screw from rotation with respect to said infant bed to allow the adjustment of the tilt angle of said infant bed and to retain said infant bed in the desired tilt angle.

6. An infant incubator as defined in claim 5 wherein said braking mechanism comprises a brake pad movable into and out of engagement with said lead screw to lock and release, respectively, said rotation of said lead screw with respect to said infant bed.

7. An infant incubator as defined in claim 6 wherein said lead screw has an enlarged diameter section and said brake pad moves into and out of engagement with said enlarged diameter section.

8. An infant incubator as defined in claim 6 wherein said brake pad is biased against said lead screw and said breaking mechanism includes a lever operable by the user against said bias to move said brake pad away from said lead screw.

9. An infant incubator as defined in claim 6 wherein said nut is resiliently affixed to said base.

10. An infant incubator as defined in claim 6 wherein said nut is affixed to said base by a gimbal means.

11. An infant incubator as defined in claim 9 wherein said resilient affixation comprises a resilient material interposed between said nut and said base to allow said nut move as said infant bed is adjusted to various tilt angles.

12. An infant incubator for containing an infant, said infant incubator having a base, an infant bed for supporting an infant mounted to said base, and a incubator hood positioned atop of said base and adapted to form an infant compartment having a controlled environment with said base to contain an infant in that environment, a tilt mechanism for allowing a user to place said infant bed at a desired tilt angle with respect to said base, said tilt mechanism comprising a lead screw having a ball at one end rotatably affixed to said infant bed and said other end threaded through a nut affixed to said base, said tilt mechanism further comprising a breaking mechanism operable by a user to lock and unlock said ball from rotation with respect to said infant bed to allow the adjustment of the tilt angle of said infant bed and to retain said infant bed in the desired tilt angle, and a locking mechanism comprising a ball release slide movable into and out of engagement with said ball to capture and release said ball from said infant bed.

13. An infant incubator as defined in claim 12 wherein said ball release slide includes a bifurcated end the captures said ball.

14. An infant incubator as defined in claim 13 wherein said ball release slide unlocks said breaking mechanism when said ball release mechanism is moved to said position out of engagement with said ball.

15. An infant care apparatus for supporting an infant, said infant apparatus having a base, an infant bed for supporting an infant mounted to said base at a pivot point so as to be tiltable with respect to said base, a tilt mechanism for allowing a user to place said infant bed at a desired tilt angle with respect to said base, said tilt mechanism comprising a lead screw rotatably affixed to said infant bed and a threaded nut affixed to said base, said lead screw adapted to pass through said threaded nut and rotate as said infant bed moves from one tilt angle two another with respect to said base, and an actuating mechanism located in close proximity to said infant bed and generally at the same level as said infant bed, said actuating mechanism adapted to be manipulated by the user to lock and unlock said lead screw to prevent and allow rotation of said lead screw with respect to said infant bed, whereby said infant bed is tiltable to a desired tilt angle and locked into said desired position.

16. An infant care apparatus for supporting an infant as defined in claim 15, wherein said apparatus is an infant warmer.

17. An infant care apparatus for supporting an infant as defined in claim 16, wherein said actuating mechanism comprises a brake pad that is movable into and out of engagement with said lead screw to prevent and allow rotation of said lead screw.

* * * * *